United States Patent [19]

Turko et al.

[11] Patent Number: 4,817,684

[45] Date of Patent: Apr. 4, 1989

[54] METHOD AND APPARATUS FOR SORPTIVELY STORING A MULTICONSTITUENT GAS

[75] Inventors: John W. Turko, River Rouge; Kenneth S. Czerwinski, Detroit, both of Mich.

[73] Assignee: Michigan Consolidated Gas Company, Detroit, Mich.

[21] Appl. No.: 97,847

[22] Filed: Sep. 16, 1987

[51] Int. Cl.[4] ..... B65B 31/00

[52] U.S. Cl. ..... 141/4; 141/11; 141/69; 141/82; 141/100

[58] Field of Search ..... 141/1, 98, 2, 4, 5, 141/7–9, 18, 37, 82, 100, 102, 11, 69, 392; 62/473; 123/1 A, 525–528; 48/190

[56] References Cited

U.S. PATENT DOCUMENTS

| | | | |
|---|---|---|---|
| 3,837,377 | 9/1974 | McJones | 141/4 |
| 4,153,083 | 5/1979 | Imler et al. | 141/4 |
| 4,522,159 | 6/1985 | Engel et al. | 123/1 A |
| 4,523,548 | 6/1985 | Engel et al. | 127/1 A |
| 4,531,558 | 7/1985 | Engel et al. | 141/44 |

FOREIGN PATENT DOCUMENTS

| | | | |
|---|---|---|---|
| 2912784 | 10/1980 | Fed. Rep. of Germany | 141/4 |

*Primary Examiner*—Ernest G. Cusick

*Attorney, Agent, or Firm*—Harness, Dickey & Pierce

[57] ABSTRACT

The disclosure relates to a method and apparatus for sorptively storing a multiconstituent gas in, and for selectively releasing the multiconstituent gas from, a vessel having a predetermined sorbent material therein, while substantially preserving minimum quantities or concentrations of certain constituents of the gas. In such a method and apparatus, a first of the constituents of the multiconstituent gas which is preferentially sorbed by the sorbent material, is present in the multiconstituent gas in a predetermined minimum concentration level substantially less than that of the second constituent. First, the sorbent material in the vessel is sorptively saturated with a pre-storage quantity of the first constituent at a first predetermined pressure. Then the multiconstituent gas to be stored is introduced under pressure into the vessel, with the vessel being pressurized to a second predetermined pressure above the first predetermined pressure. Thus both of the first and second constituents are sorptively stored in the vessel on the sorbent material therein. When the stored multiconstituent gas is selectively released from the vessel, the sorbent material desorptively release the multiconstituent gas with the first constituent being present in at least the above-mentioned predetermined concentration as the pressure in the vessel decreases.

63 Claims, 1 Drawing Sheet

FIG. 1.
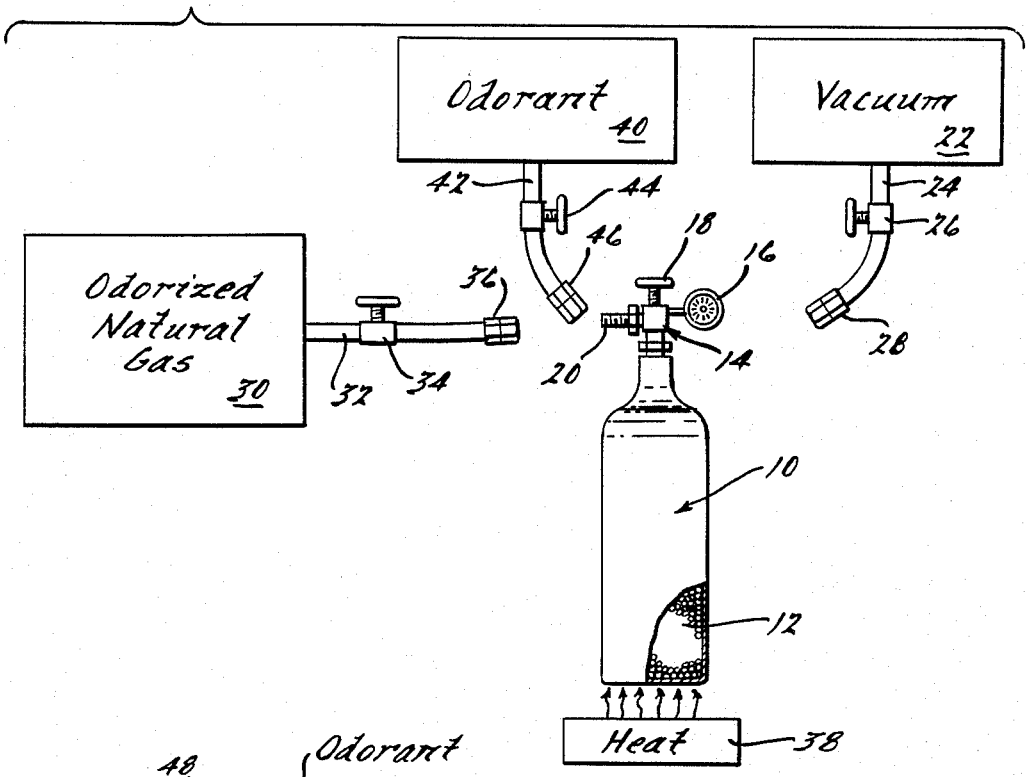
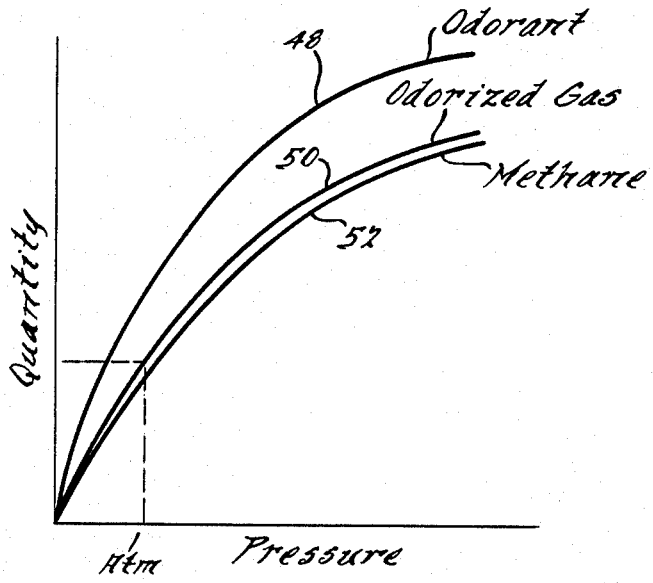
FIG. 2.
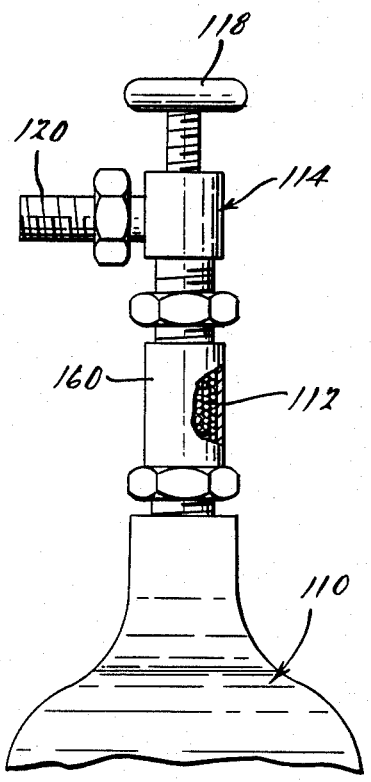
FIG. 3.

METHOD AND APPARATUS FOR SORPTIVELY STORING A MULTICONSTITUENT GAS

BACKGROUND OF THE INVENTION

The present invention relates generally to a method and apparatus for sorptively storing a multiconstituent gas, such as an odorized natural gas or other multiconstituent gaseous fuel, in a storage vessel having a sorbent material therein. More particularly, the present invention relates to such a method and apparatus for substantially preserving a relative concentration of at least one of the constituents of the multiconstituent gas at a predetermined minimum concentration level relative to other constituents of the multiconstituent gas, both before and after sorptive storage in the storage vessel. It should be noted that the terms "sorbent" and "sorptive", and the like, as used herein, refer to the use of either an adsorbent or an absorbent material.

Recently, in gaseous fuel storage applications, as well as from other gas storage applications, it has been found that the use of high-surface-area sorptive materials (adsorbents or absorbents) has provided for significantly increased storage capacities of such gases at relatively low pressures. This has led to the development of various vehicular and non-vehicular applications of gaseous fuels for both portable and non-portable gaseous fuel consuming devices. Examples of such applications are disclosed and discussed in more detail in U.S. Pat. Nos. 4,531,558; 4,523,548; 4,522,159, and No. 4,776,366 (issued Oct. 11, 1988), all of which are assigned to the same assignee as the present invention, and the disclosures of which are hereby incorporated by reference herein.

While the above-mentioned systems and apparatuses for gaseous fuel storage have proved to be highly advantageous, the use of sorbent materials for such storage frequently results in the removal of odorants or other desirable additives or constituents that have been included in such gaseous fuels for safety purposes or for other reasons deemed necessary or desirable in a particular application. Such undesirable removal of odorant additives or other desirable constituents of a multiconstituent gas typically results from the fact that such odorants, additives, or other desirable constituents frequently include heavier, longer-chain compounds that are preferentially sorbed (absorbed or adsorbed) by the sorbent material relative to the other constituents of the gaseous fuel or other gas. Consequently, although such preferentially sorbed materials are present in the gaseous fuel or other gas in predetermined minimum desirable concentrations in the gas supplied to the storage apparatus, the preferential sorption of these materials in the storage tank or vessel causes them to be substantially removed, or at least reduced to undesirably low levels, when the stored gas is removed from the storage vessel for use.

The need has thus arisen for a sorptive gas storage apparatus and method wherein predetermined minimum quantities or concentrations of certain preferentially sorbed additives or constituents of a multiconstituent gas are substantially preserved at minimum concentration levels, both before and after the multiconstituent gas is sorptively stored in the storage vessel.

In accordance with the present invention, a method and apparatus is provided for sorptively storing a multiconstituent gas in, and for selectively releasing the multiconstituent gas from, a vessel having a predetermined sorbent material therein, while substantially preserving minimum quantities or concentrations of certain constituents of the gas. In such a method and apparatus, a first of the constituents of the multiconstituent gas, which is preferentially sorbed by the predetermined sorbent material, is present in the multiconstituent gas in a predetermined minimum quantity or concentration level substantially less than the quantity of the second constituent. First, the sorbent material in the vessel is sorptively saturated with a pre-storage quantity of the first constituent at a first predetermined pressure. Then the multiconstituent gas to be stored is introduced under pressure into the vessel, with the vessel being pressurized to a second predetermined pressure that is higher than the above-mentioned first predetermined pressure. This causes both of the first and second constituents of the multiconstituent gas to be sorptively stored in the vessel on the sorbent material therein.

When the stored and pressurized multiconstituent gas is selectively released from the vessel, the sorbent material therein desorptively releases the multiconstituent gas, with the first constituent being present in at least the above-mentioned predetermined quantity or concentration, as the pressure in the vessel decreases during the desorptive release of the stored gas. Effectively, because of the pre-storage saturation of the sorbent material with the desired first constituent at a first predetermined pressure level, the desired concentration level of such preferentially-sorbed first constituent is substantially preserved in the stored multiconstituent gas being withdrawn from the storage vessel for use in a gas-consuming system or other application.

In one preferred embodiment of the invention, the above-mentioned first predetermined pressure, at which the sorbent material is sorptively saturated, is approximately equal to atmospheric pressure, but other pressures may also be desired in particular applications. Thus, when the multiconstituent gas is introduced into the storage vessel for sorptive storage therein, it is pressurized to a second predetermined pressure higher than the preferred atmospheric first predetermined pressure. Preferably, the pre-storage quantity of the first constituent is introduced into the sorbent material for sorptive saturation in a gaseous state. However, because such first constituents frequently have vapor pressures lower than the first predetermined saturation pressure, such constituents can alternatively be introduced in a liquid state, with the sorbent material sorptively retaining the first constituent in a gaseous state.

Also, in the preferred form of the invention, the sorbent material is sorptively saturated in the manner described above after the sorbent material is placed in the storage vessel. Alternatively, however, if deemed necessary or desirable in a particular application, such sorptive saturation can be performed prior to the sorbent material being placed in, or otherwise associated with, the storage vessel.

Additional objectives, advantages, and features of the present invention will become apparent from the following description and the appended claims, taken in conjunction with the accompanying drawings.

BRIEF DESCRIPTION OF THE DRAWINGS

FIG. 1 diagrammatically illustrates an exemplary gas storage apparatus and method according to the present invention.

FIG. 2 is a series of curves illustrating the relationship of pressure and stored quantity of various gases adsorbed or absorbed by a sorbent material.

FIG. 3 is an enlarged detailed view of an alternate embodiment of the present invention.

DETAILED DESCRIPTION OF THE PREFERRED EMBODIMENTS

FIGS. 1 through 3 depict exemplary embodiments, for purposes of illustration, of a sorbent gaseous fuel storage apparatus and method for use in the method according to the present invention. One skilled in the art will readily recognize from the following discussion, taken in conjunction with the accompanying drawings and the appended claims, that the principles of the present invention are equally applicable to embodiments of sorbent gas storage systems other than the particular embodiments shown in the drawings. In this regard, it should be particularly emphasized that the drawings depict one application of the invention for storage of an odorized natural gas, to which an odorant has been added in predetermined small concentration levels in order to allow for the detection of leaks or other undesired releases of the natural gas from piping or other gas systems, but the invention is not limited to this particular application.

Referring to FIG. 1, a storage vessel 10 includes a sorbent material 12 therein for sorptively storing a multiconstituent gas introduced into the storage vessel 10. Although the sorbent material 12 is preferably composed of an adsorbent material, such as activated carbon, zeolite, silica gel, or clay, for example, various other adsorbents or absorbents known to those skilled in the art can alternatively be employed.

The storage vessel 10 preferably also includes an inlet/outlet apparatus 14, having a pressure gauge 16, a shut-off valve 18, and an inlet/outlet connector 20 thereon. The inlet/outlet apparatus 14 allows the storage vessel to be selectively connected and disconnected in fluid communication with a gas supply source 30 by way of a gas supply conduit or pipe 32 having a shut-off valve 34 and a gas supply connector 36 thereon. The gas supply connector 36 is adapted for selective connection and disconnection with the connector 20 for providing fluid communication between the gas supply source 30 and the storage vessel 10.

Similarly, a source of odorant 40, or other source of a supply of a constituent of a multiconstituent gas, includes an odorant supply conduit or pipe 42, with a shut-valve 44 and an odorant supply connector 46 thereon. The odorant supply connector 46 is similarly adapted for selective connection or disconnection with the connector 20 for fluid communication between the odorant supply source 40 and the storage vessel 10. Preferred odorants commonly used with natural gas are dimethyl sulfide (DMS), tetrahydrothiothene (THT), tertiary butyl mercaptan (TBM), or combinations or blends thereof, but other known odorants, including other mercaptans or sulfides can also be used.

Also in like manner, the apparatus optionally, but preferably, includes a vacuum or depressurizing apparatus 22, with a vacuum conduit or pipe 24, a shut-off valve 26, and a vacuum supply connector 28. The vacuum supply connector is releasably connectable to the connector 20 for the optional, but preferred, depressurization of the vessel 10 prior to pre-storage saturation of the sorbent material 12, as is explained more fully below.

In addition, the sorbent material 12 is optionally, but preferably, heated by a heating apparatus 38 during the above-mentioned depressurization prior to pre-storage odorant saturation. Such heating tends to release any undesirable contaminants or other substances previously sorbed by the sorbent material 12, thus increasing its useful storage capability.

Because the odorant, or other predetermined constituent of a multiconstituent gas, from the source 40 typically is a heavier, longer-chain material, when compared with the other constituents of the natural gas (primarily methane) or other multiconstituent gas, the sorbent material 12 is capable of isothermally storing a much larger quantity (volume or mass) of the odorant than the methane at various storage pressures. Similarly, the storable quantity of pure odorant varies much more rapidly with storage pressure than does the mixture of odorant and methane, i.e. the odorized natural gas, from the source 30. The phenomenon is illustrated diagrammatically in FIG. 2, wherein various isothermic curves for pure odorant, odorized natural gas, and methane are illustrated and indicated by reference numerals 48, 50, and 52, respectively.

Because of the preferential sorptive storage phenomenon discussed above, the introduction of odorized natural gas from the source 30 into the storage vessel 10 results in the sorbent material 12 preferentially sorbing, and thus retaining, the odorant in the odorized natural gas upon release of the stored odorized natural gas from the storage vessel 10 for use in a natural gas consuming device or other natural gas system. This effect is undesirable since the purpose of the addition of odorant in small concentration levels, typically in the range of approximately two parts per million to approximately ten parts per million, is required and desirable in order to allow for the detection of leakage or other undesired natural gas releases in a gas-consuming system.

Consequently, in accordance with the present invention, the storage vessel 10 is preferably initially depressurized or evacuated (by way of connection of the vacuum apparatus 22 to the vessel 10) to a low pressure below atmospheric pressure, preferably at or close to zero absolute pressure. In addition, the sorbent material 12 is preferably heated during such depressurization, as mentioned above. Next, the odorant supply connector 46 is releasably connected with the connector 20 and the shut-off valves 18 and 44 are opened in order to introduce a supply of pure odorant from the source 40 under pressure into the storage vessel 10.

The initial pre-storage charge of the odorant from the source 40 is introduced under pressure preferably to a pressure level approximately equal to atmospheric pressure, and the sorbent material 12 in the storage vessel 10 is allowed to become sorptively saturated at approximately atmospheric pressure. Such saturation is not necessarily a total saturation, with the sorbent material being left in a partially saturated condition capable of storing the desired quantity of odorized natural gas at elevated pressures. The shut-off valves 18 and 44 are then closed, and the odorant supply connector 46 is disconnected from the connector 20. The storage vessel 10 is now charged with its pre-storage saturation level of pure odorant and is thus ready for use for storage of odorized natural gas from the source 30.

In order to load the storage vessel 10 with odorized natural gas for sorptive storage and subsequent use, the gas supply connector 36 is releasably connected with the connector 20, and the shut-off valves 18 and 34 are opened in order to introduce odorized natural gas from the source 30 into the storage vessel 10 under pressure. Such pressurized introduction of the odorized natural gas from the source 30 into the storage vessel 10 continues until a sufficient quantity of odorized natural gas is stored at a predetermined desired storage pressure, which is substantially higher than the preferred atmospheric pressure at which the sorbent material 12 was previously sorptively saturated, thus allowing the odorized natural gas from the source 30 to be stored in the storage vessel 10. During such storage, and because of the increased pressure, the sorbent material is allowed to sorptively store both the odorant and methane constituents of the odorized natural gas from the source 30. When the storage loading of the odorized natural gas from the source 30 is completed, with the odorized natural gas being sorptively stored at a predetermined desired storage pressure, the shut-off valves 18 and 34 are closed and the gas supply connector 36 is disconnected from the connector 20.

Subsequently, when use of the stored odorized natural gas is desired, the connector 20 can be releasably connected to a gas-consuming device or other gas system, and the shut-off valve 18 can be opened in order to desorptively release the stored odorized natural gas from the storage vessel 10 for use. During such release, in which the pressure of the odorized natural gas in the storage vessel 10 decreases, the sorbent material 12 in the storage vessel 10 releases both the odorant and the methane constituents of the odorized natural gas, as diagrammically illustrated by isothermic curve 50 in FIG. 2. Such release, with the odorant present in the odorized natural gas at or above the predetermined minimum concentration levels, occurs as the pressure drops from the storage pressure toward atmospheric pressure because the sorbent material 12 in the storage vessel 10 has already been saturated with nearly all the pure odorant that it can sorptively hold at atmospheric pressure, and thus it desorbs and releases the mixture of odorized natural gas during release of the stored odorized natural gas from the storage vessel 10.

It should be noted that it has been discovered that the concentrations of odorized natural gas at various pressures during release tend to increase slightly as the decreasing pressure approaches atmospheric pressure. As one skilled in the art will readily recognize, however, the concentration of odorized natural gas can acceptably vary, typically over a range of approximately two parts per million to approximately ten parts per million. Thus, so long as the odorized natural gas introduced under pressure into the storage vessesl 10 from the source 30 contains odorant in the desired acceptable concentration levels, such that the stored odorized natural gas released from a fully loaded storage vessel 10 has an odorant concentration level at or above the minimum desired concentration level, such slight increase in concentration as the decreasing pressure approaches atmospheric pressure has been found to be within the above aforementioned acceptable range.

Although the sorbent material 12 within the storage vessel 10 is preferably saturated with a pre-storage quantity of odorant after the sorbent material 12 is placed within the storage vessel 10, such pre-storage sorptive saturation can alternatively be performed prior to placing the saturated sorbent material in fluid communication or fluid flow association with the storage vessel 10. This alternate arrangement is illustrated in FIG. 3, wherein a storage vessel 110 similar to the storage vessel 10 has previously been loaded with a sorbent material in a manner similar to that illustrated in FIG. 1. A sorbent saturation cartridge in 160 is connected in fluid communication with the storage vessel 110 and includes a predetermined quantity of a sorbent material 112 therein. Preferably, the sorbent saturation cartridge 160 is placed in fluid communication between the storage vessel 110 and an inlet/outlet apparatus 114, which is substantially identical to the inlet/outlet 14 described above.

Prior to being connected as indicated above, the sorbent saturation cartridge 160 has been preferably evacuated to a low pressure substantially below atmospheric pressure, and then sorptively saturated with pure odorant in a manner similar to that described above in connection with the preferred apparatus shown in FIG. 1. Thus, as the odorized natural gas is introduced from the source 30 (see FIG. 1) under pressure in the manner described above, the increase in pressure allows the sorbent material 112 in the sorbent saturation cartridge 160 to sorptively retain more of the pure odorant from the source 40 (see FIG. 1). After the storage vessel 110 has been fully loaded, and the stored odorized natural gas is released for use, the pressure within the storage vessel 110 and the sorbent saturation cartridge 160 correspondingly decreases, forcing the sorbent material 112 in the sorbent saturation cartridge 160 to release pure odorant into the outgoing flow of natural gas, thus releasing an odorized natural gas with the minimum desired concentration level of odorant being substantially preserved.

As one skilled in the art will readily recognize, the cartridge 160, with the saturated sorbent material therein, can also alternatively be used to release an odorant or other desired materials into a previously non-odorized gas stream, or into a gas not previously containing such desired materials.

In any of the embodiments of the present invention illustrated in FIGS. 1 through 3 and described above, the sorbent material 12 or 112 can be sorptively saturated by a pre-storage quantity of odorant from the source 40, wherein the pure odorant is preferentially sorptively introduced for saturation in a gaseous state, or alternatively sorptively introduced for saturation in a liquid state. Because the vapor pressure of the pure odorant is typically substantially less than atmospheric pressure, such introduction in a liqiud state results in the odorant being sorbed for saturation by the sorbent material 12 or 112, at least partially in a gaseous state. Such introduction in a liquid state may be desirable for speed or convenience in a particular application.

The foregoing discussion discloses and describes exemplary embodiments of the present invention. One skilled in the art will readily recognize from such discussion, and from the accompanying drawings and claims that various changes, modifications and variations may be made therein without departing from the spirit and scope of the inventions as defined in the following claims.

We claim:

1. A method for sorptively storing a multiconstituent gas in, and for selectively releasing the multiconstituent gas from, a vessel having a predetermined sorbent material therein, the multiconstituent gas being composed of at least two constituents, a first of the constituents being preferentially sorbed by the predetermined sorbent material over a second of the constituents, and the first of the constituents being present in the multiconstituent gas in a predetermined minimum quantity substantially less than the quantity of the second constituent present in the multiconstituent gas, said method being adapted for substantially preventing the first constituent from being substantially sorptively removed from the multiconstituent gas upon release of the stored multiconstituent gas from the vessel, said method comprising the steps of:

sorptively saturating the sorbent material in the vessel with a pre-storage quantity of the first constituent at a first predetermined pressure;

introducing the multiconstituent gas under pressure into the vessel after the sorbent material has been sorptively saturated and pressurizing the vessel with the multiconstituent gas to a second predetermined pressure higher than said first predetermined pressure in order to cause both of the first and second constituents of the multiconstituent gas to be sorptively stored therein; and selectively releasing the stored and pressurized multiconstituent gas from the vessel, the sorbent material thereby desorptively releasing the multiconstituent gas with the first constituent present therein in at least said predetermined minimum quantity, as the pressure in the vessel decreases during said release.

2. A method according to claim 1, wherein said first predetermined pressure is approximately equal to atmospheric pressure.

3. A method according to claim 1, further comprising the step of depressurizing the vessel to a pressure lower than said first predetermined pressure prior to said step of sorptively saturating the sorbent material.

4. A method according to claim 3, wherein said first predetermined pressure is approximately equal to atmospheric pressure.

5. A method according to claim 1, wherein said sorptively saturating step includes the step of sorptively introducing said pre-storage quantity of the first constituent into the vessel in a gaseous state.

6. A method according to claim 5, further comprising the step of depressurizing the vessel to a pressure below said first predetermined pressure prior to said step of sorptively saturating the sorbent material.

7. A method according to claim 6, wherein said first predetermined pressure is approximately equal to atmospheric pressure.

8. A method according to claim 1, wherein said sorptively saturating step includes the step of sorptively introducing the first constituent into the vessel in a liquid state, the first constituent having a sufficiently low vapor pressure to allow at least a portion of said pre-storage quantity of said liquid first constituent to be sorbed by the sorbent material in a gaseous state at said first predetermined pressure.

9. A method according to claim 8, further comprising the step of depressurizing the vessel to a pressure below said first predetermined pressure prior to said step of sorptively saturating the sorbent material.

10. A method according to claim 9, wherein said first predetermined pressure is approximately equal to atmospheric pressure.

11. A method according to claim 1, wherein the sorbent material is an adsorbent material.

12. A method according to claim 11, wherein said adsorbent material includes an activated carbon.

13. A method according to claim 1, wherein said sorbent material is an absorbent material.

14. A method according to claim 1, wherein the predetermined minimum quantity of the first constituent in said multiconstituent material is in the range of approximately two parts per million to approximately ten parts per million.

15. A method according to claim 1, wherein the sorbent material is sorptively saturated with said pre-storage quantity of the first constituent after being placed in the vessel.

16. A method according to claim 1, wherein the sorbent material is sorptively saturated with said pre-storage quantity of the first constituent prior to being placed in fluid flow association with the vessel.

17. A method for sorptively storing an odorized natural gas in a vessel having a predetermined sorbent material therein, the odorized natural gas including at least a mixture of an odorant and methane, with the odorant being preferentially sorbed over the methane, and for selectively releasing the stored natural gas from the vessel in an odorized condition wherein the concentration of the odorant in the natural gas is at or above a predetermined minimum concentration level both before and after being sorptively stored in the vessel, said method comprising the steps of:

sorptively saturating the sorbent material in the vessel with a pre-storage quantity of the odorant at a first predetermined pressure;

introducing the odorized natural gas under pressure into vessel after the sorbent material has been sorptively saturated with the odorant and pressurizing the vessel with the odorized natural gas to a second predetermined pressure higher than said first predetermined pressure in order to cause both the odorant and the methane constituents of the odorized natural gas to be sorptively stored therein; and selectively releasing the stored and pressurized odorized natural gas from the vessel, the sorbent material thereby desorptively releasing the odorized natural gas with the odorant present therein in at least the predetermined minimum concentration level as the pressure in the vessel decreases during said release.

18. A method according to claim 17, wherein said first predetermined pressure is approximately equal to atmospheric pressure.

19. A method according to claim 17, further comprising the step of depressurizing the vessel to a pressure lower than said first predetermined pressure prior to said step of sorptively saturating the sorbent material.

20. A method according to claim 19, wherein said first predetermined pressure is approximately equal to atmospheric pressure.

21. A method according to claim 17, wherein said sorptively saturating step includes the step of introducing said pre-storage quantity of the first odorant into the vessel in a gaseous state.

22. A method according to claim 21, further comprising the step of depressurizing the vessel to a pressure below said first predetermined pressure prior to said step of sorptively saturating the sorbent material.

23. A method according to claim 22, wherein said first predetermined pressure is approximately equal to atmospheric pressure.

24. A method according to claim 17, wherein said sorptively saturating step includes the step of introducing said pre-storage quantity of the odorant into the vessel in a liquid state, the odorant having a sufficiently low vapor pressure to allow at least a portion of said pre-storage quantity of said liquid odorant to be sorbed by the sorbent material in a gaseous state at said first predetermined pressure.

25. A method according to claim 24, further comprising the step of depressurizing the vessel to a presure below said first predetermined pressure prior to said step of sorptively saturating the sorbent material.

26. A method according to claim 25, wherein said first predetermined pressure is approximately equal to atmospheric pressure.

27. A method according to claim 17, wherein the sorbent material is an adsorbent material.

28. A method according to claim 27, wherein said adsorbent material includes an activated carbon.

29. A method according to claim 17, wherein said sorbent material is an absorbent material.

30. A method according to claim 17, wherein the predetermined minimum concentration level of the odorant in the odorized natural gas is in the range of approximately two parts per million to approximately ten parts per million.

31. A method according to claim 17, wherein the sorbent material is sorptively saturated with the odorant after being placed in the vessel.

32. A method according to claim 17, wherein the sorbent material is sorptively saturated with the odorant prior to being placed in the vessel.

33. A method for sorptively storing an odorized natural gas in a vessel having a predetermined sorbent material therein, the odorized natural gas including a mixture of at least an odorant and methane, with the odorant being preferentially sorbed by the sorbent material over the methane, and for selectively releasing the stored natural gas from the vessel in an odorized condition wherein the concentration of the odorant in the natural gas is at or above a predetermined minimum concentration level both before and after being sorptively stored in the vessel, said method comprising:

depressurizing the sorbent material to a pressure substantially below atmospheric pressure;

sorptively saturating the sorbent material with a quantity of the odorant to a first pressure substantially equal to atmospheric pressure;

introducing the odorized natural gas under pressure into the vessel after the sorbent material has been sorptively saturated to a pressure above atmospheric pressure in order to cause both the odorant and the methane in the odorized natural gas to be sorptively stored therein; and selectively releasing the stored and pressurized odorized natural gas from the vessel, the sorbent material thereby desorptively releasing the odorized natural gas with the odorant present therein in at least said predetermined minimum concentration level as the pressure in the vessel decreases during the said release.

34. A method according to claim 33, wherein said sorptively saturating step includes the step of sorptively introducing said quantity of the odorant into the sorbent material in a gaseous state.

35. A method according to claim 33, wherein said saturating step includes the step of sorptively introducing said quantity of the odorant into the vessel in a liquid state, the odorant having a sufficiently low vapor pressure to allow at least a portion of said quantity of said liquid odorant to be sorbed by the sorbent material in a gaseous state at atmospheric pressure.

36. A method according to claim 33, wherein the sorbent material is an adsorbent material.

37. A method according to claim 36, wherein said adsorbent material includes an activated carbon.

38. A method according to claim 33, wherein the sorbent material is an absorbent material.

39. A method according to claim 33, wherein the predetermined minimum concentration level is in the range of approximately two parts per million to approximately ten parts per million.

40. A method according to claim 33, wherein the sorbent material is sorptively saturated with said quantity of the odorant after being placed in the vessel.

41. A method according to claim 33, wherein the sorbent material is sorptively saturated with said quantity of the odorant prior to being placed in fluid flow association with the vessel.

42. An apparatus for sorptively storing a multiconstituent gas in, and for selectively releasing the multiconstituent gas from, a vessel having a predetermined sorbent material therein, the multiconstituent gas being composed of at least two constituents, a first of the constituents being preferentially sorbed by the predetermined sorbent material over a second of the constituents, and the first of the constituents being present in the multiconstituent gas in a predetermined minimum quantity substantially less than the quantity of the second constituent present in the multiconstituent gas, said apparatus being adapted for substantially preventing the first constituent from being substantially sorptively removed from the multiconstituent gas upon release of the stored multiconstituent gas from the vessel, said apparatus comprising:

means for sorptively saturating the sorbent material in the vessel with a pre-storage quantity of the first constituent at a first predetermined pressure;

means for introducing the multiconstituent gas under pressure into the vessel after the sorbent material has been sorptively saturated and pressurizing the vessel with the multiconstituent gas to a second predetermined pressure higher than said first predetermined pressure in order to cause both of the first and second constituents of the multiconstituent gas to be sorptively stored therein; and means for selectively releasing the stored and pressurized multiconstituent gas from the vessel, the sorbent material thereby desorptively releasing the multiconstituent gas with the first constituent present therein in at least said predetermined minimum quantity, as the pressure in the vessel decreases during said release.

43. An apparatus according to claim 42, wherein said first predetermined pressure is approximately equal to atmospheric pressure.

44. An apparatus according to claim 42, further comprising means for depressurizing the vessel to a pressure lower than said first predetermined pressure prior to sorptively saturating the sorbent material.

45. An apparatus according to claim 44, wherein said first predetermined pressure is approximately equal to atmospheric pressure.

46. An apparatus according to claim 42, wherein the sorbent material is an adsorbent material.

47. An apparatus according to claim 46, wherein said adsorbent material includes an activated carbon.

48. An apparatus according to claim 42, wherein said sorbent material is an absorbent material.

49. An apparatus according to claim 42, wherein the sorbent material is sorptively saturated with said pre-storage quantity of the first constituent after being placed in the vessel.

50. An apparatus according to claim 42, wherein the sorbent material is sorptively saturated with said pre-storage quantity of the first constituent prior to being placed in fluid flow association with the vessel.

51. An apparatus for sorptively storing an odorized natural gas in a vessel having a predetermined sorbent material therein, the odorized natural gas including at least a mixture of an odorant and methane, with the odorant being preferentially sorbed over the methane, and for selectively releasing the stored natural gas from the vessel in an odorized condition wherein the concentration of the odorant in the natural gas is at or above a predetermined minimum concentration level both before and after being sorptively stored in the vessel, said apparatus comprising:

means for sorptively saturating the sorbent material in the vessel with a pre-storage quantity of the odorant at a first predetermined pressure;

means for introducing the odorized natural gas under pressure into vessel after the sorbent material has been sorptively saturated with the odorant and pressurizing the vessel with the odorized natural gas to a second predetermined pressure higher than said first predetermined pressure in order to cause both the odorant and the methane constituents of the odorized natural gas to be sorptively stored therein; and means for selectively releasing the stored and pressurized odorized natural gas from the vessel, the sorbent material thereby desorptively releasing the odorized natural gas with the odorant present therein in at least the predetermined minimum concentration level as the pressure in the vessel decreases during said release.

52. An apparatus according to claim 51, wherein said first predetermined pressure is approximately equal to atmospheric pressure.

53. An apparatus according to claim 51, further comprising means for depressurizing the vessel to a pressure lower than said first predetermined pressure prior to said step of sorptively saturating the sorbent material.

54. An apparatus according to claim 51, wherein said first predetermined pressure is approximately equal to atmospheric pressure.

55. An apparatus according to claim 51, wherein the sorbent material is an adsorbent material.

56. An apparatus according to claim 55, wherein said adsorbent material includes an activated carbon.

57. An apparatus according to claim 51, wherein said sorbent material is an absorbent material.

58. An apparatus according to claim 51, wherein the sorbent material is sorptively saturated with the odorant after being placed in the vessel.

59. An apparatus according to claim 51, wherein the sorbent material is sorptively saturated with the odorant prior to being placed in the vessel.

60. An apparatus for sorptively storing an odorized natural gas in a vessel having a predetermined sorbent material therein, the odorized natural gas including a mixture of at least an odorant and methane, with the odorant being preferentially sorbed by the sorbent material over the methane, and for selectively releasing the stored natural gas from the vessel in an odorized condition wherein the concentration of the odorant in the natural gas is at or above a predetermined minimum concentration level both before and after being sorptively stored in the vessel, said apparatus comprising:

means for depressurizing the sorbent material to a pressure substantially below atmospheric pressure;

means for sorptively saturating the sorbent material with a quantity of the odorant to a first pressure substantially equal to atmospheric pressure;

means for introducing the odorized natural gas under pressure into the vessel after the sorbent material has been sorptively saturated to a pressure above atmospheric pressure in order to cause both the odorant and the methane in the odorized natural gas to be sorptively stored therein; and means for selectively releasing the stored and pressurized odorized natural gas from the vessel, the sorbent material thereby desorptively releasing the odorized natural gas with the odorant present therein in at least said predetermined minimum concentration level as the pressure in the vessel decreases during the said release.

61. An apparatus according to claim 60, wherein the sorbent material is an adsorbent material.

62. An apparatus according to claim 61, wherein said adsorbent material includes an activated carbon.

63. An apparatus according to claim 60, wherein the sorbent material is an absorbent material.

* * * * *